US006874598B1

(12) United States Patent
Baker

(10) Patent No.: US 6,874,598 B1
(45) Date of Patent: Apr. 5, 2005

(54) ERGONOMICALLY IMPROVED TRIPOD STEPLADDER

(76) Inventor: William H. Baker, 3212 NW. 35th St., Oklahoma City, OK (US) 73112

( * ) Notice: Subject to any disclaimer, the term of this patent is extended or adjusted under 35 U.S.C. 154(b) by 7 days.

(21) Appl. No.: 10/685,927

(22) Filed: Oct. 15, 2003

Related U.S. Application Data

(60) Provisional application No. 60/418,380, filed on Oct. 15, 2002.

(51) Int. Cl.[7] ..... E06C 1/00
(52) U.S. Cl. ..... 182/165; 182/173
(58) Field of Search ..... 182/165, 173, 182/174, 175, 176, 170

(56) References Cited

U.S. PATENT DOCUMENTS

| | | | | | |
|---|---|---|---|---|---|
| 2,397,468 | A | * | 4/1946 | Cail | 182/170 |
| 2,440,831 | A | * | 5/1948 | Pease | 182/175 |
| 2,650,014 | A | | 8/1953 | Harrison | |
| 3,165,169 | A | * | 1/1965 | Machen | 182/170 |
| 3,269,486 | A | * | 8/1966 | Machen | 182/170 |
| 4,249,637 | A | | 2/1981 | Glasgow | |
| 4,524,849 | A | | 6/1985 | Riddle | |
| 4,600,080 | A | | 7/1986 | Forrester | |
| 4,632,220 | A | * | 12/1986 | Murrell | 182/170 |
| 4,646,876 | A | | 3/1987 | Grawi | |
| 4,754,845 | A | | 7/1988 | Baker | |
| 5,590,739 | A | | 1/1997 | High et al. | |
| 5,685,391 | A | | 11/1997 | Gundlach | |
| 6,206,139 | B1 | | 3/2001 | Bogart, Jr. | |
| 6,347,687 | B1 | | 2/2002 | Alim | |
| 6,378,655 | B1 | | 4/2002 | Campbell | |
| 6,386,320 | B1 | | 5/2002 | Clavel | |

FOREIGN PATENT DOCUMENTS

| | | |
|---|---|---|
| WO | WO 92/11425 | 7/1992 |

* cited by examiner

*Primary Examiner*—Hugh B. Thompson, II
(74) *Attorney, Agent, or Firm*—James F. Harvey, III

(57) ABSTRACT

An inventive stepladder of tripod structure with an actuating mechanism that extends the rear legs and front step assembly in a coordinated manner to assume the tripod footprint. The actuating mechanism may include a vertical center post; a sliding collar journaled on the center post to coordinate the extension and retraction of the rear legs and step assembly; an A-brace for extending and retracting the step assembly and further serving as an auxiliary work platform for the uppermost step in the step assembly; leg braces for extending and retracting the rear legs, and a stop block attached to the lower end of the center post. A locking pin may be provided to secure the position of the sliding collar along the center post. The stop block may function to relieve shear stress on the locking pin and to provide support for a user's weight on the A-brace.

17 Claims, 10 Drawing Sheets

ERGONOMICALLY IMPROVED TRIPOD STEPLADDER

CROSS-REFERENCES TO RELATED APPLICATIONS

The present patent application claims the benefit of the filing date of U.S. Provisional Patent Application No. 60/418,380, filed Oct. 15, 2002, and entitled "Ergonomically Improved Tripod Stepladder".

FIELD OF THE INVENTION

The present invention relates to the field of folding ladders, and particularly, to standard stepladders, and more particularly, to stepladders of a triangular or tripod aspect.

BACKGROUND OF THE INVENTION

Stepladders provide a means for an individual to climb to a height for manipulating objects or performing work in locations where the stepladder must be free standing and not resting against a support. The stepladder depends solely upon its construction and erection to ensure its stability, in contrast to extension ladders that must be braced against a structure.

A typical stepladder is designed to be folded into a convenient size for storage and carrying, and the requirement that it be portable is a major design constraint, restricting the weight of the ladder. Thus, a typical stepladder will be found to weigh thirty pounds (approximately 15 kilograms) or less in weight, in order to ensure that it may be easily handled. It is also designed to be folded into a package that, insofar as possible, is not of significantly increased size over a folded ladder of similar height-reaching capability.

The basic A-frame design of the common stepladder as a self-supporting climbing device was conceived around the year 1880, and this design has been used with only minor modifications to the present day. It comprises a pair of vertical, elongated structural members or rails, between which are attached steps, and a complementary pair of rear legs which extend to the rear of the ladder from the top cap to form a supporting structure in the form of an A-shaped frame. Some modifications and improvements have been made to this basic design, but the ladder industry has followed this design without fundamental alteration to the present day.

The stability of stepladders is affected by the user's movement on the stepladder during use. The requirement that the stepladder be portable tends to reduce the weight to the minimum consistent with required structural strength. Since an average user will weigh about one hundred fifty pounds (about sixty eight kilograms), practically all the weight involved in the dynamic coupling between the stepladder and the user will be concentrated in the user, and there will be very little static weight tending to stabilize the ladder. Thus the location of the user's weight (the user's center of gravity) determines the static stability of the stepladder in use. If a plumb line from the user's center of gravity falls outside the footprint of the stepladder, then the stepladder will topple. Motion of the user on the stepladder will further couple to the stepladder, creating a tendency in the traditional double A-frame stepladder to "walk" over the surface. Such walking is indicative of one leg of the stepladder being unloaded and may result in toppling, which may cause potential injury to the user.

Since tripods are known to be inherently stable structures, especially on uneven ground, various attempts have been made to create stepladders of triangular structure, with independent rear legs. As an example, Harrison, U.S. Pat. No. 2,650,014 discloses such a structure. However, the independently articulated rear legs lack the firm bracing of the typical A-frame stepladder. The resulting structure may lack adequate dynamic stability.

A similar prior structure is shown in the inventor's prior published U.S. Pat. No. 4,754,845. The disclosure described a stepladder having a rigid step section means, a strengthening top cap, and two independently articulated and angled rear legs, the legs and step section means extending from the top cap to form essentially an equilateral triangular footprint. The articulation of the rear legs and step section means was accomplished by a triangular vertical column, or center post, extending downwardly from the bottom of the top cap and journaling a sliding coupler, or collar, to which rigid support means (rear braces) were attached each leg to extend and retract the rear legs as the collar was moved up and down along the vertical post. A rigid support means was also affixed to the step section means. The rear braces were linear and not hinged or broken as in the prior art.

While this invention was inherently stable because of its essentially triangular footprint, it had a number of problems. The sliding collar was prone to jamming with dirt because of its exposed position, and the pin locking the sliding collar in a particular location was vulnerable to shearing off and becoming lodged when weight was applied to the structure. Furthermore, the front and rear bracing attached to the sliding collar frequently caught the user's fingers as the stepladder was extended and retracted. It was found that, because of its placement near a step, the front bracing encouraged the user to use it as a support, which led to premature failure of the front bracing. The hinging arrangement of the step section means and rear legs to the top cap was weak and prone to breakage, as well as catching objects as the stepladder was extended and retracted. While the structure described in this patent was stable, it was not manufacturable or practical for commercial or home use.

The invention disclosed in International Publication Number WO92/11425 (Publication Date 9 Jul. 1992, based on PCT Appl. No. PCT/US90107498, to Baker, later abandoned) provided a number of improvements over this the disclosure of U.S. Pat. No. 4,754,845. One improvement consisted of a redesigned triangular center post and sliding collar. The locking mechanism was revised to eliminate a vertical slot and internal horizontal plate in favor of an external pin biased by a spring to externally engage holes vertically spaced along the center post. A lever controlling the release of the locking pin is recessed in channels on the sliding collar to prevent accidental release. Another improvement consisted of alignment channels on the sliding collar to maintain the braces in an equal angular position, reduce misalignment of the ladder, and maintain the entire structure as a more rigidly braced tripod. The resulting structure was substantially free from torsion or twisting moments induced either by placing the stepladder on an uneven surface or by the shifting of weight of the user (creating unequal loads on the supporting structure). However, this structure too exhibited a number of problems that rendered it impractical for use. The pin in the sliding collar was still prone to shearing and jamming as the user's weight was applied to the structure. Users were still prone to use the front bracing for support, resulting in premature failure of the front bracing.

Some industry enhancements addressing the stability issue involve stabilizing structures added to the basic A-frame support structure. Various methods have been proposed, including the implementation of a tapering rail configuration where the side rails are wider at the bottom than at the top. This method provides a wider base to the basic A-frame supporting structure but complicates the manufacturing process, in that the steps are not uniform in length. Other such methods include the use of spreader bars connected to the side rails. These typically pose a serious threat of injury to fingers and hands.

Another issue involves the materials from which the ladder is made. Originally, the A-frame supporting structure and all its accompanying attachments were made of wood. Wood is inexpensive but it is not durable, prone to rot and splits, and it is heavy. However, one advantage of wood is that when dry it does not conduct electricity or heat and is useful in applications involving electrical repairs. More recent A-frame stepladders have been fabricated of more contemporary materials such as fiberglass or metal. Each material has its own advantages and disadvantages. Aluminum is lighter and easier to handle, but conducts electricity. Fiberglass is non-conductive, tough, easy to form during the manufacturing process, but it tends to deteriorate in sunlight, exposing interior glass fibers to the hands. It is also brittle and relatively heavy, all of which create problems in carrying and handling. The Occupational Safety and Health Administration (OSHA) requires many employees working in an electrical environment to use a non-conductive ladder.

Other improvements have consisted of equipment supporting means for holding and securing work materials, such as paint buckets, tools, and the like, to the topmost portion of the stepladder for convenience and to reduce the number of trips the worker must make up and down the ladder in order to obtain additional equipment. Still other improvements have consisted of stabilizing means to prevent the stepladder from falling.

Ergonomics is the study of the relationship between individuals and their work or working environment, especially with regard to fitting jobs to the needs and abilities of workers. The essential nature of ergonomics is the convergence of the disciplines of human biology (especially anatomy, physiology, and psychology) on the problems of man at work. As applied to stepladders, ergonomics is an integral part of safety.

While these enhancements represent improvements over prior art, experience in field testing with prototypes has identified certain safety issues and ergonomic concerns that are not adequately addressed in the prior art. A prime concern is lack of shielding of hinge mechanisms. The exposed joints allow fingers to be pinched and collect debris on moving parts with a resulting potential for increased resistance to movement of the activating mechanism and rear legs, and excess wear at hinge points resulting in reduced reliability and potential structural failure.

By definition, a stepladder is a portable tool. Its justification depends on its usefulness. In normal use, a stepladder is hand carried to a job site, set up, and stood on to elevate the user while performing work. Ideally, then, in addition to having structural integrity and being reliable, a stepladder should be easy and comfortable to carry, simple and safe to set up, stable, and provide an adequate storage medium for hand tools and supplies. This description defines the meaning of functional ergonomics as applied to stepladders. Normally a stepladder is carried by holding it horizontally by the side rails. In materials other than wood, this is usually an open C-channel, with small-radius, or sharp corners. The weight of the average stepladder combined with this type of side rail makes it uncomfortable to carry. This same C-channel is the primary point of manual contact for most other handling of the stepladder as well.

The ultimate test of utility for a stepladder is its ability to store hand tools and supplies for the user while performing work. In the traditional stepladder, two surfaces have been given cursory attention toward this end, i.e. the paint tray and the top cap. Without restraining sidewalls, the paint tray provides little holding capacity. Any motion of the stepladder is telegraphed to this surface, and objects placed on it frequently end up on the ground. Holes in the top cap are limited mostly to screwdrivers and such. Together, they offer inadequate tool storage for the average user.

In everyday use, many stepladders are used in areas without a firm, level, supporting surface, e.g. a concrete floor. Particularly on construction sites, the ground is usually uneven, and frequently soft. An important safety consideration is the total area of contact of the ladder's feet with the ground, since this determines how well it supports the weight of the user. In the case of the traditional stepladder, the area of each foot approximates the cross-sectional area of the C-channels used for side rails and rear legs. This is inadequate to contribute meaningfully to the safety of the user in unimproved environments, particularly since the weight of the user is transferred from front to rear as the user climbs up the ladder, and the rear feet are normally much smaller.

Another prime concern, particularly in the inventor's prior tripod designs, is durability of the actuating mechanism. Extensive field testing revealed that, in the extended position, the braces connecting the sliding collar with the step assembly offer a convenient "platform" for the feet of the person standing on the stepladder, since these braces are positioned adjacent to a step. This puts heavy downward pressure on the actuating mechanism, and in particular, the sliding collar. This results in a significant shearing force on the locking pin holding the sliding collar in position along the center post. Since it is not possible to prevent the user from standing on these braces, the entire actuating mechanism, including the center post, is redesigned to provide structural integrity adequate to withstand such pressure.

As can be seen, there is a need for a safer, more functional, and ergonomic stepladder. Using the previous definition of ergonomics, the ideal stepladder should (1) have structural integrity, (2) be reliable, (3) be easily and comfortably carried, (4) be simple and safe to set up, (5) be stable, and (6) provide an adequate storage medium for hand tools and supplies.

SUMMARY OF THE INVENTION

In one aspect of the invention, an stepladder may be comprised of a step assembly and two independently articulated legs pivoted from a top cap, the step assembly having two parallel side rails pivotally connected to the top cap, and one or more steps affixed therebetween; a center post with an upper end and a lower end, the upper end fixed to the top cap, the center post extending downwardly and vertically from the top cap; a sliding collar journaled on the center post; leg braces with each leg brace pivotally affixed at a first end to the sliding collar and pivotally affixed at a second end to one of the legs, the leg braces of a length that the center post is at equal angles vertically to each leg; an A-brace pivotally affixed at a first end to the sliding collar and pivotally affixed at a second end to the step assembly; and a means on the sliding collar for maintaining the planes of extension for the rear legs and step assembly at equal radial angles with respect to each other. The stepladder according to the invention may have an operable position and a closed position, where the operable position may be defined by the sliding collar in a lowest position on the center post causing the rear legs and step assembly to be fully extended, and where the closed position may be defined by the sliding collar in a highest position on the center post causing the rear legs and step assembly to be substantially touching. The plane of extension for a rear leg is the vertical plane formed by the leg brace, the leg, and the center post and the plane of extension for the step assembly is the vertical plane extending through the center post and a bisector of the plane formed by the side rails, whereby the planes of extension are at 120° angles with each other.

In another aspect of the invention, an actuating apparatus is provided for a stepladder of a type having a step assembly, a first leg, and a second leg, the legs being independently articulated with the legs and step assembly pivotally attached to a top cap, each leg pivoting along a vertical plane, and the vertical planes being separated by an angle of about 120°. The actuating apparatus may comprise a center post with an upper end and a lower end with the center post extending downwardly from an underside of the top cap and having a horizontal flange at its lower end; a sliding collar journaled on the center post, where the sliding collar has three housings with centerlines extending radially outward from the center post at an angle of approximately 120° with an adjacent centerline; a means for locking the sliding collar at a position along the center post; a first and second rigid leg brace, the first leg brace being pivotally affixed at a first end within a first housing and pivotally affixed at a second end to the first leg, and the second leg brace being pivotally affixed at a first end within a second housing and pivotally affixed at a second end to the second leg, where the leg braces are of a length such that the center post is at equal angles vertically to each leg; an A-brace pivotally affixed at a first end within a third housing and pivotally affixed at a second end to the step assembly; where the A-brace is of such a length that it is substantially horizontal when the step assembly is fully extended; and a stop block journaled on the center post, where the stop block is supported by and resting upon the horizontal flange.

These and other features, aspects and advantages of the present invention will become better understood with reference to the following drawings, description, and claims. For a better understanding of the invention, its operating advantages and the specific objects attained by its uses, reference should be made to the accompanying drawings and descriptive matter in which there are illustrated preferred embodiments of the invention. The foregoing has outlined some of the more pertinent objects of the invention. These objects should be construed to be merely illustrative of some of the more prominent feature and applications of the present invention. Many other beneficial results can be attained by applying the disclosed invention in a different manner or by modifying the invention within the scope of the disclosure. Accordingly, other objects and a fuller understanding of the invention and the detailed description of the preferred embodiments in addition to the scope of the invention illustrated by the accompanying drawings.

The present invention will now be described with reference to the following drawings, in which like reference numbers denote the same element throughout. These and other features, aspects, and advantages of the present invention will become better understood with reference to the following drawings, description, and claims. These objects should be construed to be merely illustrative of some of the more prominent features and applications of the present invention. Many other beneficial results can be attained by applying the disclosed invention in a different manner or by modifying the invention within the scope of the disclosure.

DETAILED DESCRIPTION OF THE INVENTION

The following detailed description shows the best currently contemplated modes of carrying out the invention. The description is not to be taken in a limiting sense, but is made for the purpose of illustrating the general principles of the invention and the best mode for practicing the invention, since the scope of the invention is best defined by the appended claims. As used in the context of this invention, the term "stability" implies that a stepladder remains upright without undue and unwanted movement during use, and that the structure may be sufficiently durable so as to maintain that degree of stability under prolonged use.

The invention may provide an inventive tripod stepladder having improvements over the prior art that are directed towards ergonomics and manufacturability. According to the invention, the inventive stepladder may have a number of safety features that promote safe operation. Some of these safety features include (1) an actuating mechanism that may be operated without risk of injury from pinching or catching of fingers in the mechanism during extension and retraction of the legs; (2) a utility step functioning as a bracing means that an user may stand upon during use of the ladder; (3) a top cap for holding tools, providing integral pivot points for the legs and the step assembly, providing tactile warning points to the user when leaning out from the ladder, and providing structural stability and strength to the ladder; and (4) a unique mechanism for controlling stepladder extension. These improvements represent a substantial improvement over the prior art that render the present invention a more practical device for commercial and home use.

Regarding instability problems of prior art double A-frame stepladders, virtually all may be overcome by the use of a tripod structure. The tripod configuration may adapt readily to uneven surfaces and do so without generating the degree of torsion forces that cause the traditional stepladder to "walk" and subsequently topple. The ideal stepladder may be strong and rigid enough to support the weight of the user and tools, and yet flexible enough to adapt readily to uneven surfaces without creating undue torsion stress and its related instability, or weakening of the structure. There should be a balance between rigidity and flexibility; safety and ergonomics; and durability. The present invention addresses these issues, as will be seen.

Figure 1:
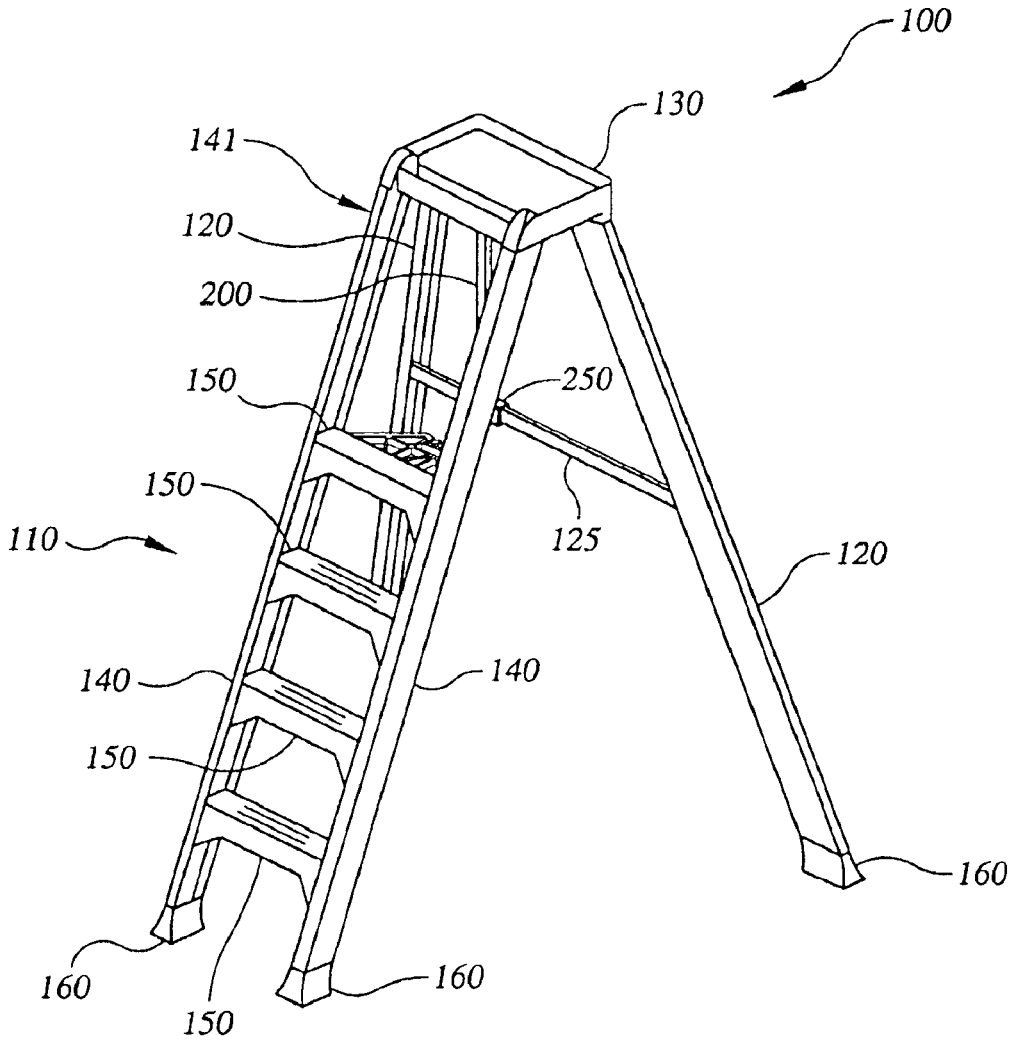
FIG. 1 is a frontal perspective view of a tripod stepladder with the rear legs extended, according to an embodiment of the invention.

Referring now to FIG. 1, a perspective view of an embodiment of the inventive stepladder 100 is shown. The stepladder 100 may comprise a step assembly 110 and two rear legs 120 all pivotally connected to a top cap 130 and arranged so that, when extended, the footprint of the stepladder 100 is generally of a tripod shape. A first end of a leg brace 125 may be pivotally connected to each rear leg 120 so that it may control the extent of outward travel for the rear leg 120. The second end of the leg brace 125 may be pivotally connected to a sliding collar 250 journeled on a center post 200. The tripod shape represented by this configuration may be inherently stable.

The step assembly 110 may be fabricated from two side rails 140 that are spaced apart by a number of horizontal steps 150. Each side rail 140 may have a cross sectional shape in the form of a "C" within which to accommodate the steps 150. Since most stepladders are commonly carried by the side rail 140, the edges of the open "C" may be rounded with a large radius to make the grip more comfortable for the person carrying the stepladder 100. This may increase the strength and rigidity of the stepladder 100, absorb impact forces better, and provide a more comfortable handling surface. The two side rails 140 may be slightly tapered at the upper end 141 with a traditional 30 taper to provide a wider base, which in traditional stepladders provides more stability than parallel side rails 140. The side rails 140 comprising the step assembly 110 may also be parallel in lieu of the 30 taper characteristic of a stepladder in the prior art, where this taper is the principal source of stability. Since the tripod arrangement of the present invention is inherently stable, with the spread of the rear legs 120 on vertical planes that are 120° laterally from the centerline of the step assembly 110, then removing the taper and arranging the side rails 140 parallel with each other does not compromise stability. Parallel side rails 140 may advantageously make transportation and storage easier. They may also enhance manufacturability of the step assembly 110 by permitting the steps 150 to be constructed with equal length and thus reducing part count, work station equipment costs, and labor.

Each side rail 140 may be constructed of any material and cross sectional area that jointly may provide rigidity and strength. Materials typically having these characteristics may be wood, aluminum, steel, durable plastic, fiberglass, and the like, but other such materials may be used without departing from the scope of the invention. Typical cross sectional areas may be rectangular, square, octagonal, circular, C-channel, and the like, but other such cross sectional areas may be used without departing from the scope of the invention. According to an embodiment of the invention shown in FIG. 1, each side rail 140 may have a cross sectional area in the shape of a C-channel to provide support for a step of the same width. The same qualification of material and cross sectional area may be applied to each rear leg 120 without departing from the scope of the invention. The central longitudinal portion of the side rail 140 may be slightly recessed to increase its strength and provide a flattened area where safety-oriented labels may be applied and better protected.

Figure 3A:
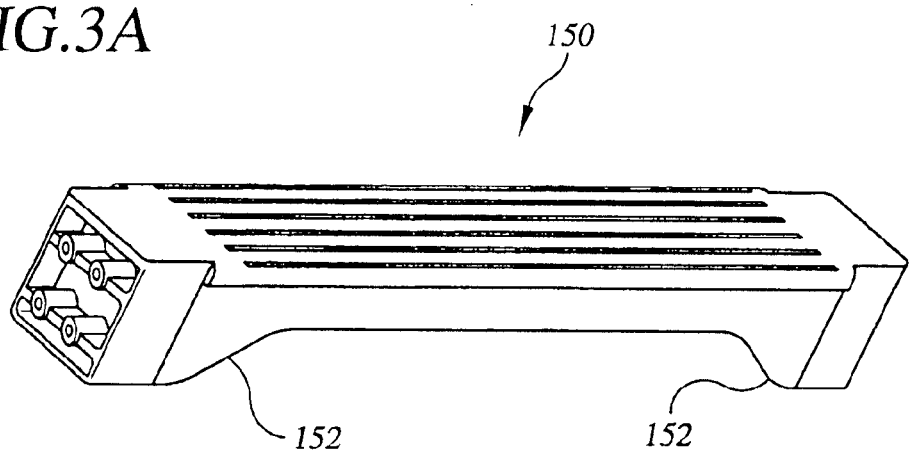
FIG. 3A is a top perspective view of a step for a tripod stepladder, according to an embodiment of the invention.
Figure 3B:
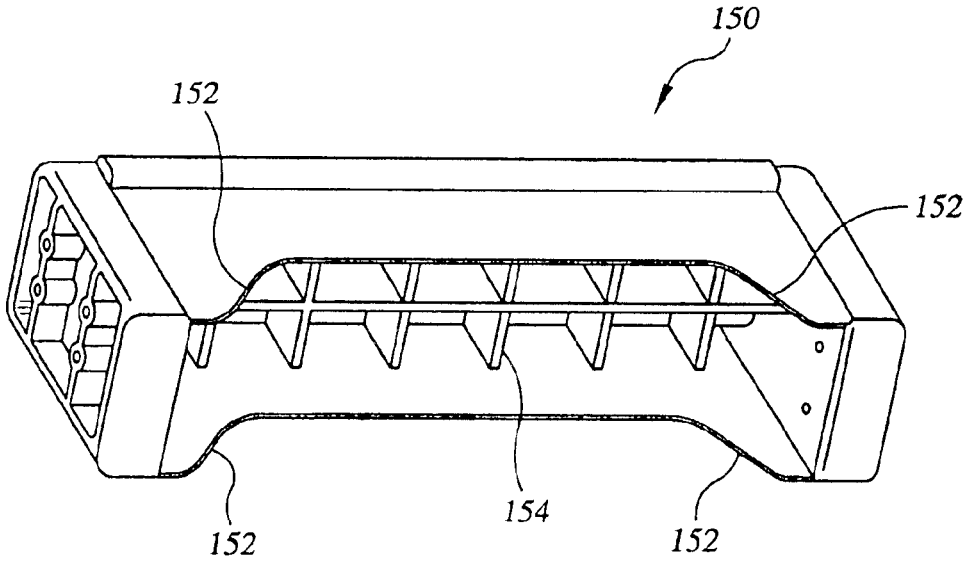
FIG. 3B is a perspective view of the underside of a step for a tripod stepladder further illustrating methods of reinforcement, according to an embodiment of the invention.
Figure 4A:
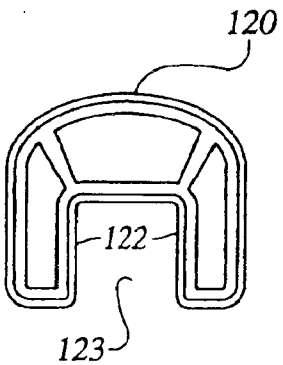
FIGS. 4A–4F are views depicting possible cross sections for different embodiments of the rear leg for the invention.
Figure 4B:
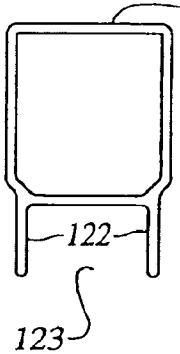
Figure 4C:
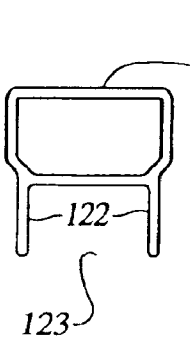
Figure 4D:
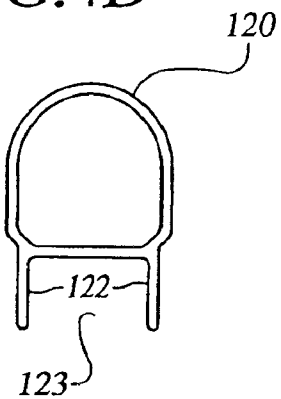
Figure 4E:
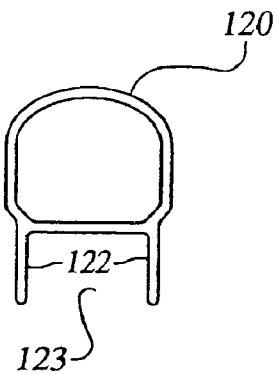
Figure 4F:
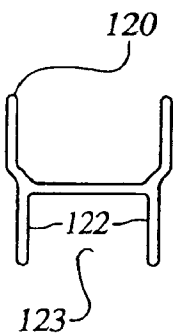

Referring now to FIGS. 3A and 3B, an embodiment of a step 150 is shown. Steps 150 may be made of appropriate materials known to the art, such as wood, aluminum, steel, plastic, composite materials, and the like. Steps 150 may also be fabricated according to standard methods known to the art, such as injection molding; machining or cutting from blank stock; casting; and the like. The step 150 shown in FIGS. 3A and 3B may be molded with integral braces 152 that maintain the step 150 in a horizontal orientation with respect to the side rails 140 and keep the step assembly 110 from twisting in the plane formed by the two side rails 140, i.e. from side to side. In an embodiment in which the side rails 140 are parallel, the integral brace 152 may maintain a perpendicular relationship between the plane of the step 150 and each side rail 140. In the prior art, the upper and lower steps are generally braced with separate angled external braces. Molding an internal brace 152 in this manner may reduce the number of parts necessary to manufacture the stepladder 100 and thus reduce cost of inventory and labor for assembly. Additionally, step 150 may have integral webbing 154 that further enhances its rigidity.

The side rails 140 and the rear legs 120 may terminate in insulated, friction producing feet 160, that may be made of such materials as rubber, plastic, or similar materials having a high friction and load absorbing capability. According to an embodiment of the invention, they may have a ribbed lower ground gripping face and have upper extensions engaging the outer surfaces of the side rails 140 and rear legs 120 to resist impacts and sliding tendencies. The feet 160 may enclose the ends of the side rails 140 and rear legs 120 to prevent unwanted debris, dirt, and other foreign matter from being packed therein, in the event that they are hollow. By enclosing the ends of the leg sections 120, 140, the feet 160 also serve as protective padding, to lessen impact damage by the stepladder 100 as it is moved about. Prior art stepladders typically have a total area of contact with a supporting surface of around 10 square inches or less; this contact area provided by the feet 160 in the present invention may be as much as 25 square inches. Such an increased contact area may provide an extra margin of safety when the stepladder 100 is used on uneven, unstable surfaces typically encountered on construction and other field sites.

Each rear leg 120, as seen in general in FIG. 1 and in cross section in FIG. 4, may be in the form of a hollow channel or extrusion having high compressive strength and rigidity against bending. They may be fabricated from such materials as aluminum, fiberglass, plastics, composites, or combinations of these materials. From one side of the rear leg 120 may extend two parallel flanges 122 to form an alignment channel 123 therebetween running the length of the rear leg 120. Although these alignment channels 123 may be formed only for that portion of the rear leg 120 within which the leg braces 125 may be captured, the alignment channels 123 may extend the length of the rear leg 120 to provide additional strength and rigidity. Since most inadvertent contact with an erect stepladder may be with the outer surface of the rear legs and side rails, the rear legs 120 may be ergonomically contoured to reduce or eliminate hard corners and edges.

Figure 2A:
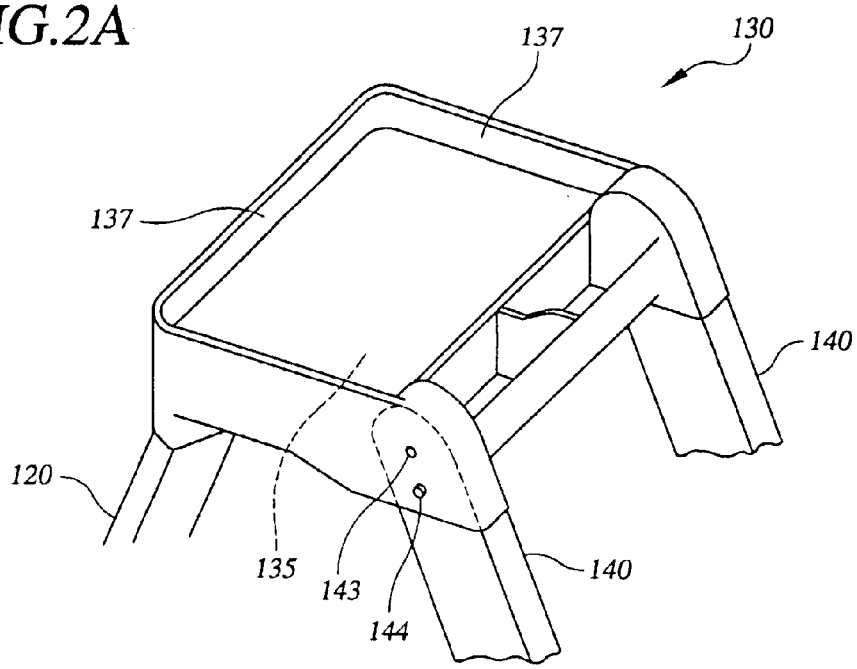
FIG. 2A is a top perspective view of a top cap of a tripod stepladder, according to an embodiment of the invention.
Figure 2B:
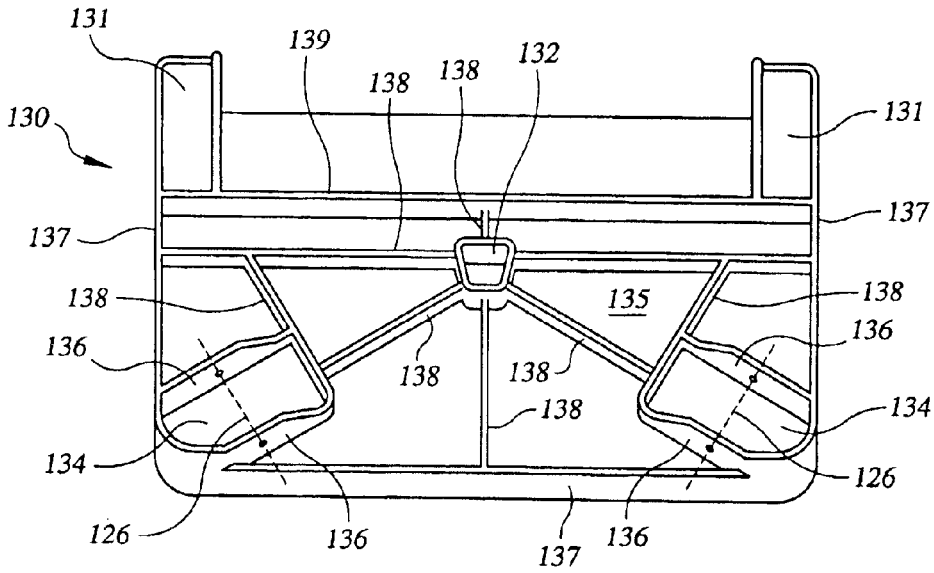
FIG. 2B is a perspective view of the underside of a top cap of a tripod stepladder, showing structural ribbing, attachment points for rear legs and a step assembly, and a receiving receptacle for a center post, according to an embodiment of the invention.

Referring now to FIGS. 2A and 2B, a top cap 130 may serve as the platform for positioning the side rails 140 of the step assembly 110 and the rear legs 120, as well as the center post 200 that will be described presently, into a tripod arrangement. The top cap 130 may be surrounded by a reinforcing skirt 137 about its perimeter. The side rails 140 and the rear legs 120 may each have separate pivot, or hinge, points on the underside 135 of the top cap 130. As shown in FIG. 2B, the side rails 140 may be positioned within a side rail receptacle 131 and pivotally fastened to the top cap 130 by a rail pin 143, about which the step assembly 110 may pivot during coordinated extension and retraction of the step assembly 110 and rear legs 120. A guide pin 144 engaged within the top cap 130 may be free to slide within an arcuate recess (not shown) within each side rail 140 so that the side rail 140 may be constrained to pivot about the rail pin 143 within a restricted arc. Each rear leg 120 may similarly be inserted into a rear receptacle 134 that may be molded into the top cap 130 and pivotally fastened by means of a rear pin 126 inserted through the walls 136 of the rear receptacle 134. The upper end of the rear leg 120 may be chamfered, or angled, so that it may be parallel to and in contact with the underside 135 of the top cap 130 when the rear legs 120 are in their extended position.

Both the side rail receptacle 131 and the rear leg receptacle 134 may be sufficiently deep so that the walls of the respective receptacles 131, 134 may provide additional lateral support to the inserted members in order to resist bending forces. These receptacles 131, 134 may enclose the hinge points to form a pocket that shrouds and protects the hinge points from debris that may hinder operation of the joint and from errant fingers. The receptacles 131, 134 may be positioned at the outermost corners of the top cap 130 to ensure that any weight placed upon the top cap 130 may be confined within the perimeter of the supporting structure. This positioning may facilitate interconnection of the walls of the receptacles 131, 134, the outer skirt 137 of the top cap 130 with floor pan reinforcement webbing 138, thus creating a much superior part in terms of strength and resistance to stress. The side rail receptacles 131 positioned at the corners of the top cap 130 where a user may stand may also serve as a tactile warning device to signal the user of the stepladder that his/her center of gravity is approaching toward the outer limits of safety. Since the tripod stance of this ladder eliminates the "walking" warning of the traditional stepladder, a substitute warning may be desirable. The side rail receptacles 131 may protrude far enough to put tactile pressure on the legs when the user approaches the limits of safety and serve as a warning device and a partial restraint.

In one embodiment of the stepladder, the upper end 141 of each side rail 140 that pivotally attaches to the top cap 130 may be fabricated as a separate part called a side rail connector (not shown) to provide a transition from an open C-channel profile of the side rail 140 to the side rail receptacle 131 on the underside 135 of the top cap 130. In another embodiment of the stepladder 100, the function of the side rail connector may be integrally included in the fabrication of the side rail 140. In any event, the upper end 141 may be configured in such a way that, when the side rail 140 is in a fully extended position, the upper end 141 substantially conforms with and contacts the uppermost interior portion of the side rail receptacle 131 so as to provide a broad support surface. In this manner, upper end 141 may carry and spread loads, with the full-surface contact with the top cap 130 minimizing wear while providing a smoothly operating joint.

When a user ascends a stepladder, the user's weight may be progressively transferred to the rear legs 120, so that at the fourth step on a six-foot stepladder, slightly over 60% of the user's weight may be supported by the step assembly 110. Most of this weight may be supported at the corners of the top cap 130 at its front side where the side rails 140 may be connected. To accommodate curved surfaces of the "user-friendly" side rails 140, and still provide a connection to the top cap 130 with the desired structural integrity and operating ease, a separate side rail connector (not shown) may be used. It snugly and firmly fits both the curves of the side rail and the rectangular opening of its connecting socket-like shroud in the top cap. It may be molded with a large hub and rivet holes, both with reinforcing webbing. To assure ease of operation during extension and retraction of the rear legs 120, the upper surface may be curved to mate with the inner contour of the side rail receptacle 131 in the top cap 130. The side rails 140 may pivot slightly with the top cap 130 during the extension and retraction of the rear legs 120. A large upper hole may house a rivet, bolt, or pin that functions as the hinge axis. A lower, arcuate slot in the side rail connector may accommodate a reinforcing rivet, bolt, or pin.

The usefulness of a stepladder may depend upon the amount and variety of work that can be performed while using it. This work capability may be enhanced by having within easy reach the tools and supplies needed to perform that work. Building contractors and safety engineers have stated that user safety is directly related to the number of trips up and down the stepladder for accessing and storing tools and supplies. The top cap 130 may provide a large usable surface area with a small, upward projecting rim for containing and holding limited amount of tools and supplies. The top cap 130 may enhance the industrial engineering concept of "Span of Control", since the top cap 130 may be ideally positioned to store tools and supplies. It may have double front wall that may form a divided pocket in which small parts can be stored separately, and readily retrieved by virtue of a curved bottom. Such a double wall feature may also provide extra strength and rigidity to the front half of the top cap 130 between the attachment points of the side rails 140.

Figure 5:
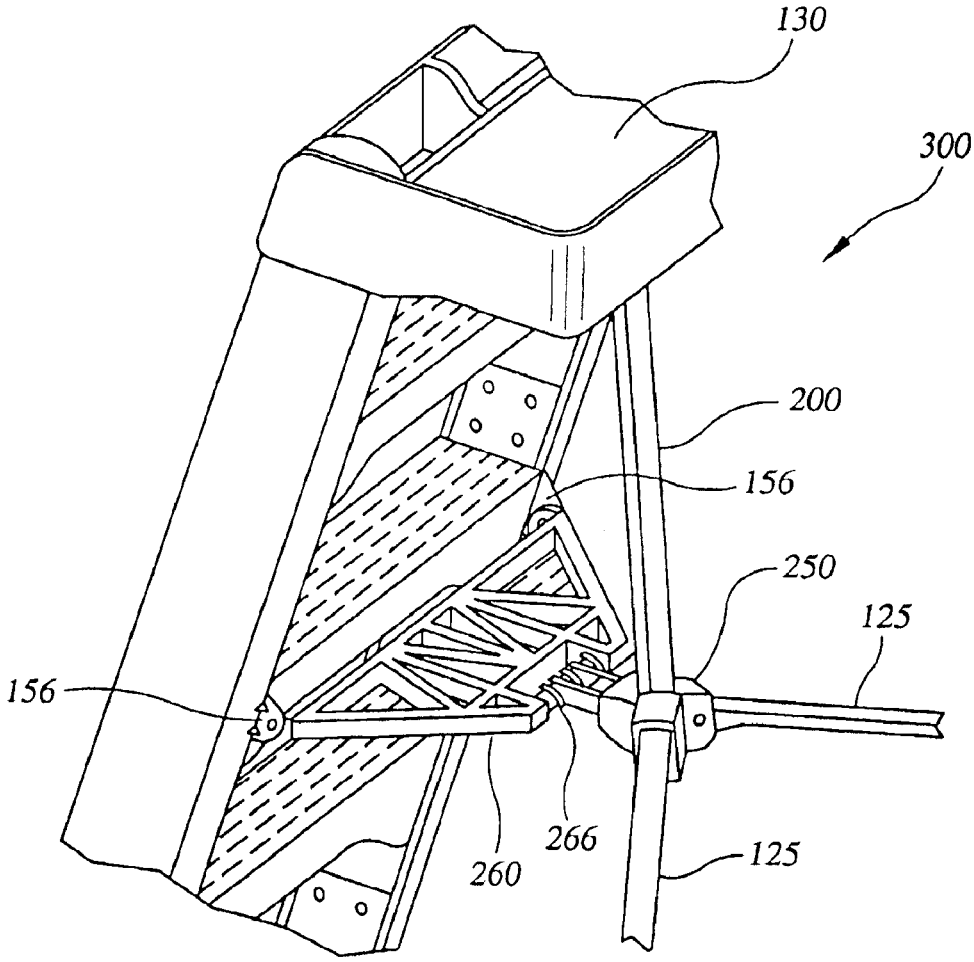
FIG. 5 is a perspective view of the utility step and its relationship with the sliding collar and the step assembly, according to an embodiment of the invention.
Figure 6:
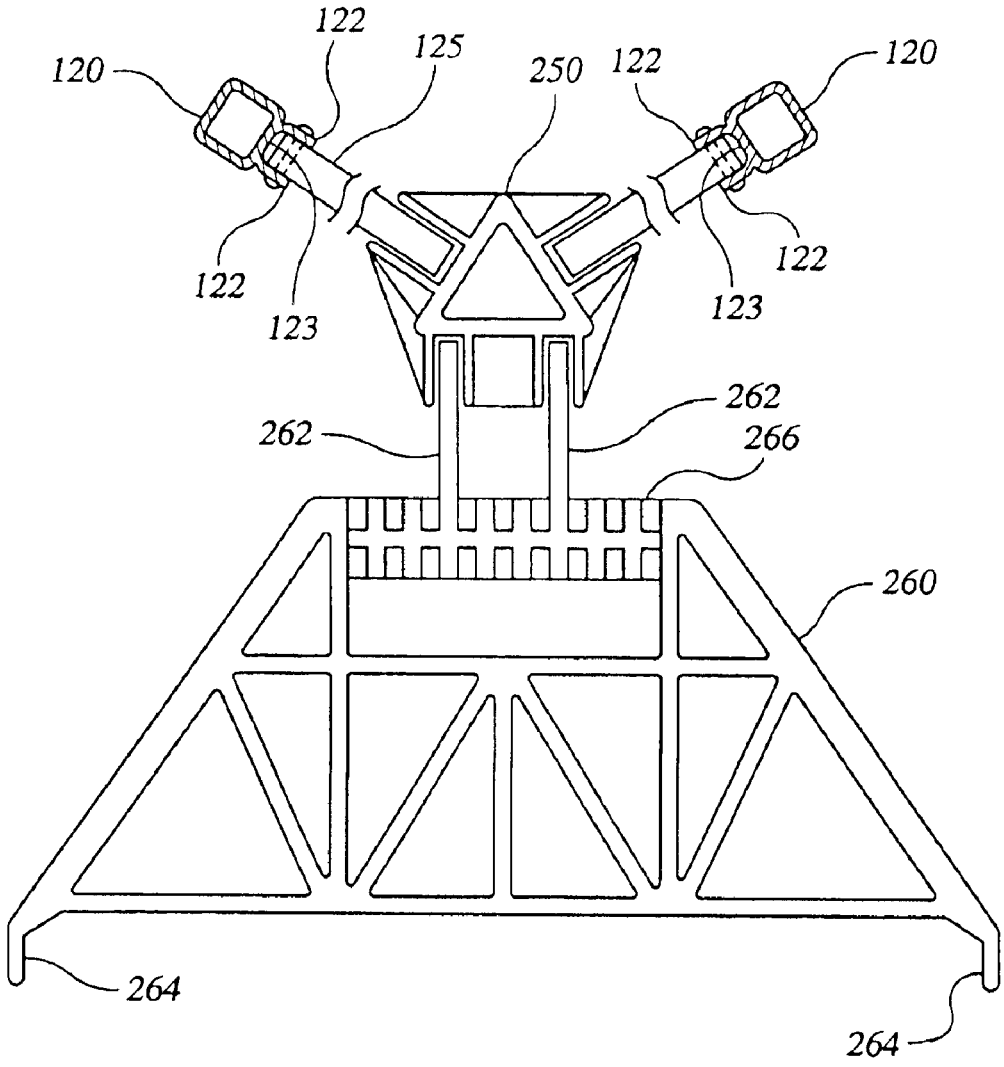
FIG. 6 is a top cross sectional view of the utility step, the sliding collar, and the braces, according to an embodiment of the invention.

Referring to FIGS. 5 and 6, an embodiment of an actuating apparatus 300, according to the invention, may be seen. The actuating apparatus 300 may include a center post 200, a sliding collar 250, an A-brace 260, leg braces 125, and a stop block 270. The center post 200 may be fastened to the underside 135 of the top cap 130 in a center post receptacle 132 (FIG. 2B). The center post 200 may extend downwardly and vertically from the underside 135 of the top cap 130 to define a center axis about which the stepladder 100 may be extended and retracted. While the center post 200 may have any suitable cross sectional area, the embodiment shown in FIGS. 5 and 6 may show a center post 200 having a triangular cross section.

Figure 9:
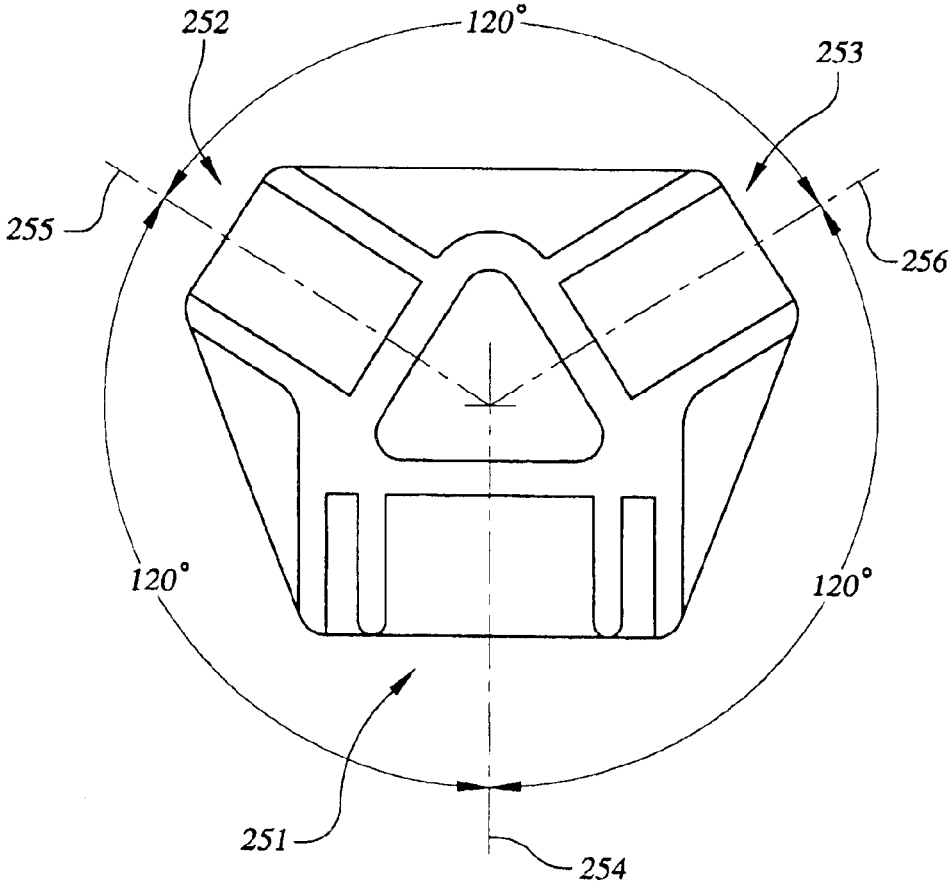
FIG. 9 is a schematic top view of a sliding collar showing the geometrical arrangement of the housings for two leg braces, the arms of an A-brace, and a latching assembly, according to an embodiment of the invention.
Figure 10:
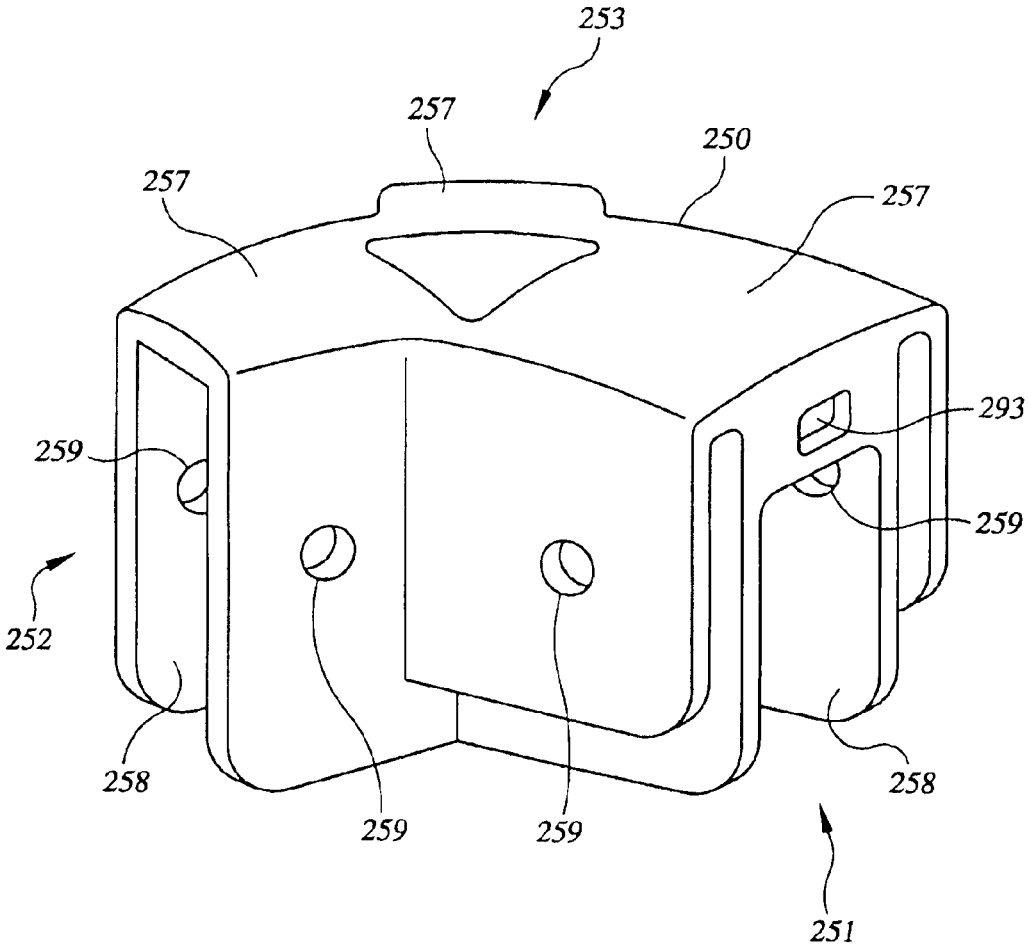
FIG. 10 is a perspective view of a sliding collar with two of its three housings in view, according to an embodiment of the invention.

Journaled around the center post 200 may be a sliding collar 250, as shown more particularly in FIGS. 9 and 10. The sliding collar 250 may be an easily operated mechanism that, when guided by the center post 200, may extend and retract the rear legs 120 and step assembly 110 in a single motion with one hand. The may sliding collar 250 have three outwardly extending housings 251, 252, and 253, each having a centerline 254, 255, and 256 extending radially from the center axis. The centerlines 254–256 form a 120° angle with the adjacent centerline 254–256. Each of the centerlines defines a vertical plane of extension for the component pivotally affixed within the respective housing. Each housing 251–253 may have a cover 257 for shielding hinge points from interference by debris and protecting the user's hands from being caught in the apparatus, as well as downwardly extending housing walls 258. Pairs of coaxially aligned holes 259 may be provided within each housing 251–253, so that pins (not shown) may be inserted and serve as axes for pivotal rotation of the leg braces 125 and pin 286 may serve as an axis for pivotal rotation of the A-brace arms 262. A leg brace 125 may be pivotally affixed within each of the housings 252–253. Housing 251 may contain a latching assembly (to be described presently) and A-brace arms 262 which may be pivotally affixed therein. The angle of the cover 257 for each housing 251–253 may be configured to conform to the angle of the leg braces 125 and A-brace arms 262 when they are fully extended, so that the cover 257 may provide additional support thereby.

Referring again to FIGS. 5 and 6, the A-brace 260 may be in the form of a ribbed platform supported by two A-brace arms 262 on one side and by two A-brace tabs 264 on the opposing side. The A-brace tabs 264 may be pivotally connected to corresponding step tabs 156 that may be either fabricated with the corresponding step 150 to reduce the part count of the apparatus or affixed to the step 150 by conventional means known to the art. An actuating handle 266 may be provided and adapted for operation by one hand for extension and retraction of the actuating apparatus 300. The handle 266 may be perpendicular to the plane of movement of the A-brace 260, which may result in a more natural motion of the user's hand, wrist, and arm. The step 150, step tabs 156, and A-brace 260 may be aligned in such a way that, when the A-brace 260 is positioned in a generally horizontal orientation, it may be coplanar with the top of step 150 so as to extend the surface of step 150. It has been observed that users, either inadvertently or intentionally, may use the A-brace 260 for support and steadying purposes while working. Specifically, they will use the A-brace 260 connecting the sliding collar 250 to the step assembly 110 as an extension of the step 150, i.e. as a platform on which to stand. This may create loads on these parts that may result in a potential safety hazard and failure of the A-brace arms 262 or sliding collar 250. Accordingly, additional support for this platform may be provided by a stop block 270, to be described presently, and positioning the A-brace arms 262 within the housing 251 in the sliding collar 250 so that, when full extended, the upper surfaces of the A-brace arms 262 may be supported by the cover 257 and walls 258 of the housing 251. The end result of the redesign may be greater structural integrity for the stepladder 100, improved ease of operation, operational safety, and a component that may function as a brace, a handle, and an extension of a step that provides firm, comfortable footing when working at the upper level of the stepladder 100.

Note that the A-brace 260 may be attached to the highest step upon which standing is recommended. At this height, the user's center of gravity is high and the vulnerability of the user to falling may be greater than when standing on the lower steps. This platform feature of the A-brace 260 may provide expanded, firm footing, which, when coupled with the inherent stability of the tripod stance of the supporting structure of the stepladder 100, may significantly reduce ladder-related injuries. For users who may frequently stand at the level on which this A-brace 260 may be located, the step 150 immediately above this location may be removed for convenience.

Figure 7:
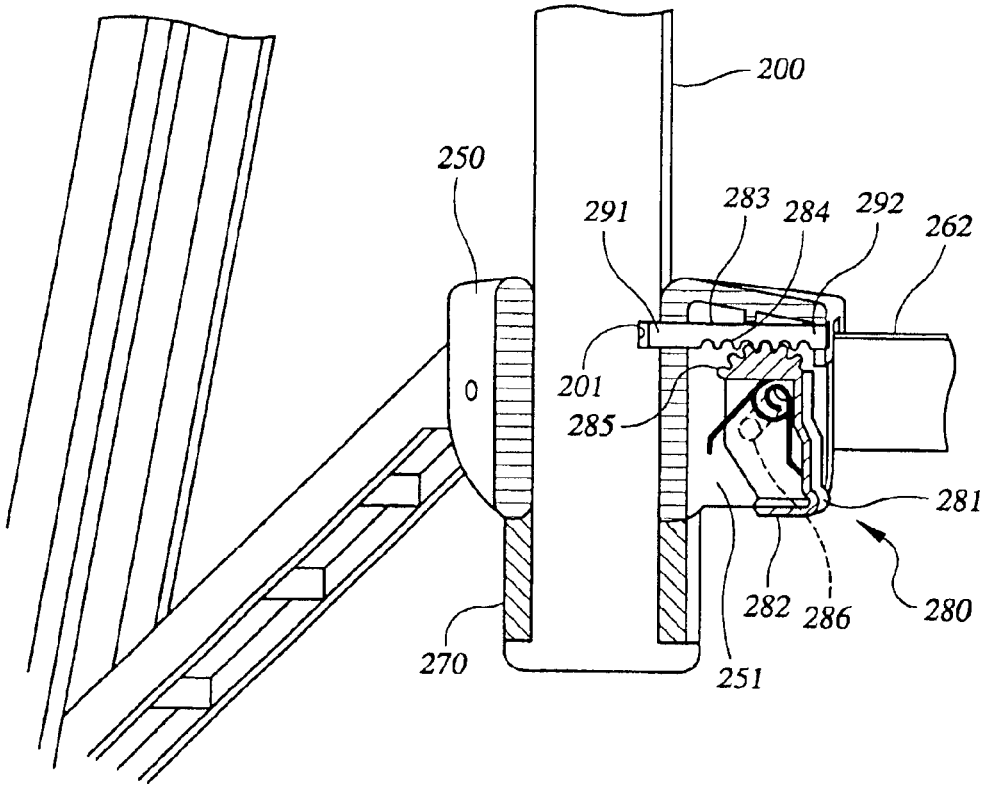
FIG. 7 is a cut away perspective view of the internal mechanism for the lock release lever and pin in the sliding collar, according to an embodiment of the invention.
Figure 8:
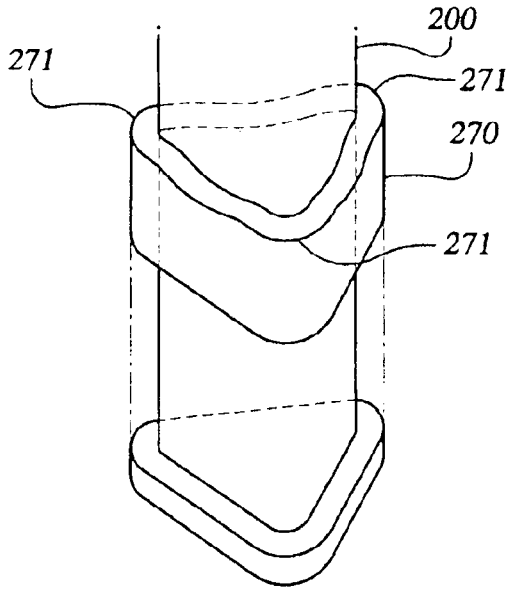
FIG. 8 is a exploded perspective view of the end of the center post with the stop block moved to show details, according to an embodiment of the invention.

A stop block 270 positioned at the lower end of center post 200, shown in FIGS. 7 and 8, may provide resilient support for the sliding collar 250. The stop block 270 may be made from any suitable resilient material known to the art. It may conform to the outside shape of the center post 200 and supported horizontally by a center post flange 205, which may either be integral with the center post 200 or fixedly attached to the center post by conventional means such as bolts, rivets, bonding materials, and the like. The stop block 270 may be slightly higher at its corners 271 and slightly concave therebetween, so that when the sliding collar 250 is brought down onto the stop block 270, it may encounter the corners 271 initially, which will compress and provide a shock absorbing effect without permanent deformation. The stop block 270 may cushion the impact that results from vigorous extension of the rear legs 120, as well as further supporting the weight of an user standing on the A-brace 260 behind the step 150. The stop block 270 may also function to minimize shear forces against the locking pin 283, as will be presently described.

A latching assembly 280 may be positioned within housing 251 of the sliding collar 250, as seen in FIG. 7, for locking the stepladder 100 into a particular position. The latching assembly 280 may include an open sided lock release lever 282 having teeth 285 arcuately arranged along its upper edge for engagement with corresponding teeth 284 arranged linearly along the lower edge of a locking pin 283. The lock release lever 282 may be positioned within housing 251 to rotate about the same housing pin 286 (shown in phantom line) supporting the A-brace arm 262. A biasing means may be provided to continuously apply a biasing force against the locking pin 283 to ensure that it has a tendency to remain engaged within one of the engagement locking holes 201 linearly positioned along the center post 200 so that they are oriented in the same direction. In operation, a user may press on the lock release lever 282 with a thumb against the biasing force, causing the lock release lever 282 to rotate clockwise (as viewed in FIG. 7). The clockwise rotation may cause the teeth 285 on the lock release lever 282 to engage teeth 284 of locking pin 283 and move it out of the engagement locking hole 201, thus allowing the sliding collar 250 to be moved vertically along the center post 200. The locking pin 283 may ride along the outer surface of the center post 200 until another hole 201 is encountered, whereupon the biasing means, continuously urging the lock release lever 282 to rotate in a counterclockwise direction, may force the locking pin 283 into the engagement locking hole 201. The user may defeat this tendency of the biasing means by applying an opposing force on the lock release lever 282 until the sliding collar 250 is properly positioned. The lock release lever 282 may be sufficiently wide to permit a user's gloved hand to actuate the lock release lever 282. A lip 281 along the bottom edge of the lock release lever 282 may be provided. The lip 281 may assure better contact by the gloved hand through the lock release lever's arc of movement, thus providing a more positive release. The lock release lever 282 and the handle of the A-brace 260 may be configured in close proximity so that both may be operated by a user with either hand while standing in front of the stepladder 100.

Figure 11:
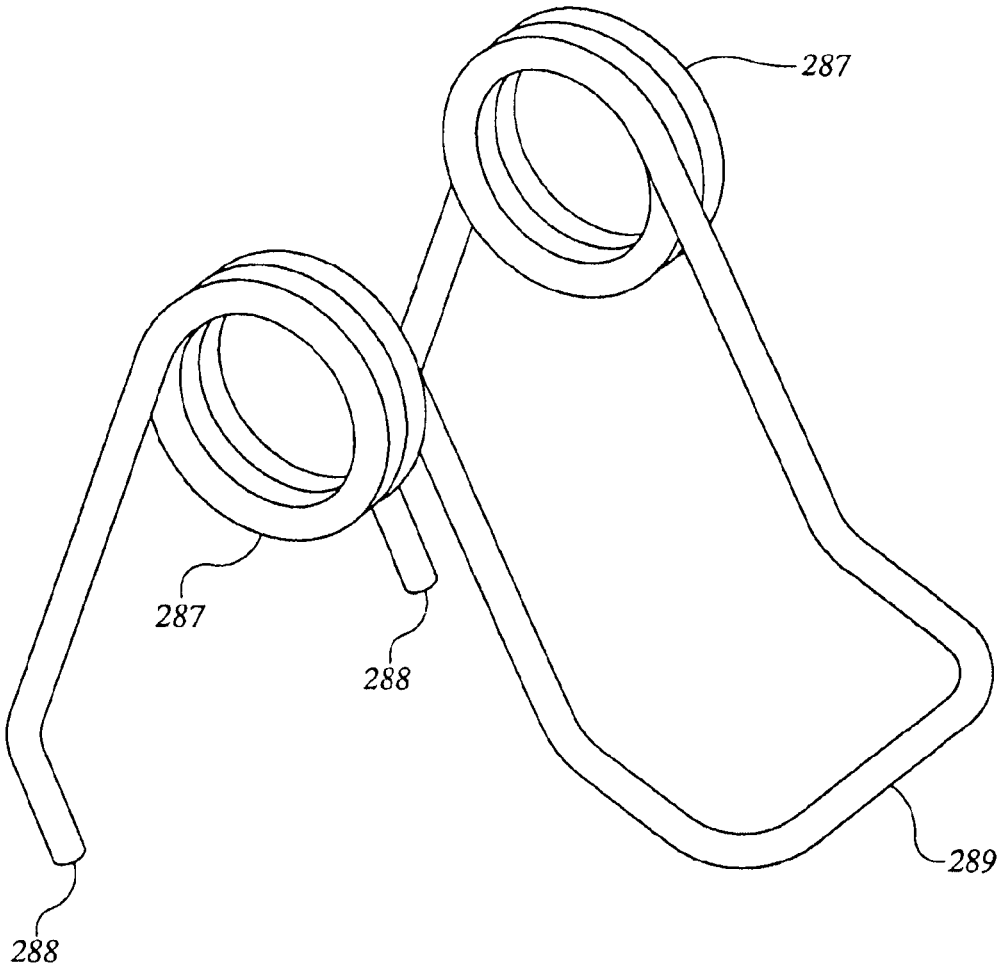
FIG. 11 is a perspective view of a torsion spring providing a bias force for the latching assembly, according to an embodiment of the invention.

In the present embodiment, the biasing means may be a doubly wound torsion spring 290 positioned within the cavity of the lock release lever 282 and around the housing pin 286 to provide the outward bias to the lock release lever 282. As shown more particularly in FIG. 11, the torsion spring 290 may have multiple coils 287 coaxially wound and joined by a spring base 289 in a continuous manner, so that the coils 287 and spring base 289 may be formed of a continuous wire. The ends 288 of the torsion spring 290 may be positioned against the innermost wall 258 of the housing 251 and the spring base 289 may be positioned against an inner surface of the lock release lever 282, so as to provide the outward bias. While other types of biasing means may be used and still be within the scope of the invention, the two coils 287 may provide a redundant biasing capability, so that if the torsion spring fatigues and breaks somewhere along its extent, then one of the coils 287 may still provide the necessary biasing force until the torsion spring 290 can be replaced. Furthermore, the spring base 289, being smooth and continuous, may not frictionally wear the inner surface of the lock release lever 282 and thereby improve durability and reliability of the mechanism. This may significantly expand the surface in contact with the lock release lever 282, providing smoother action, reduced wear, and improved reliability.

The outer end 292 of the locking pin 283 may be squared to prevent the locking pin 283 from rotating within the housing 251 and allowing the teeth 284, 285 from becoming disengaged. A conforming opening 293 (FIG. 10) may be provided within the housing 251 to position and support locking pin 283. Note that any cross-sectional shape may be used for the outer end 292 without departing from the scope of the invention. Since the outer end 292 may extend from the conforming opening 293 when the locking pin 283 is not engaged in the engagement locking hole 201, then the presence of the protruding outer end 292 may be a visual warning to the user that the locking pin 283 might not be fully engaged in the center post 200 and may become a safety feature. The inner end 291 of locking pin 283 may be circular and slightly tapered to accommodate for slight play and misalignments of the sliding collar 250 with the central post 200, and thereby enter the engagement locking holes 201 more easily. Additionally, the engagement locking holes 201 in the center post 200 may be made conical and recessed to provide a more positive, self-centering seating action for the locking pin 283.

To minimize shear force on the locking pin 283, the stop block 270 may function to absorb the inertial force of the components of the stepladder 100 that may be in motion when the locking pin 283 engages the lowest engagement locking hole 201 in the center post 200 during extension of the rear legs 120. The stop block 270 may be made of resilient plastic of a shape conforming to the cross-sectional shape of the center post 200, with the corners 271 curving upward to be slightly higher than the upper surfaces between adjacent corners 271. When the downwardly moving sliding collar 250 meets stop block 270 when the rear legs 120 reach their extended position, the initial point of contact may be with the corners 271. As the inertial impact force is absorbed, the area of contact between these two components, i.e. the stop block 270 and the sliding collar 250, may gradually increases until both components are in full contact, thus providing a progressive cushioning, or shock absorbing effect. The stop block 270 may also absorb the downward pressure created when the user stands on the A-brace 260 and its associated step 150. To relieve the shear pressure on the locking pin 283 in these situations, the lowest engagement locking hole 201 in the center post 200 may be slightly elongated in a vertical direction to the extent that the stop block 270 may be compressed under such loads and impact forces. Shear force against locking pin 283 may also be reduced by optionally increasing the wall thickness of the center post 200.

Engagement locking holes 201 may be located along the length of the center post 200 as needed, with the highest and lowest holes positioned so that the stepladder 100 may be locked in its extended position or in its retracted position by the locking pin 283. This locking feature of the invention, where the rear legs 120 and step assembly 110 may be firmly held in extended and retracted positions, may contribute to the ease of carrying the stepladder 100. In the closed position, this locking feature may prevent the rear legs 120 from swinging out when the stepladder 100 is carried horizontally by its side rail 140.

In operation, the sliding collar 250 may be moved along the center post 200 by reaching between the steps 150 from the front side of the step assembly 110 and gripping the handle 266 on the A-brace 260. By lifting up or pressing down on the handle 266, the sliding collar 250 may be moved along the center post 200 until the locking pin 283 engages with one of the engagement locking holes 201, at which point the biasing means may force the locking pin 283 into an engagement locking hole 201, latching the sliding collar 250 at a fixed vertical position along the center post 200. One such vertical position may be provided for holding the rear legs 120 and step assembly 110 in a substantially retracted, or closed, position, with the inner ends of the leg braces 125 being raised with respect to the outer ends of the leg braces 125, which in turn may draw the rear legs 120 into and against the step assembly 110 of the stepladder 100 and providing a closed ladder form for storage or carrying.

A lower engagement locking hole 201 may be provided, wherein the rear leg 120 and leg braces 125 approach a horizontal position, being slightly tilted, providing maximum extension of the rear legs 120 with respect to the step assembly 110; this is the principal operable position. Additional engagement locking holes 201 may be provided for intermediate open positions as desired, although the stability of a tripod ladder, in general, may be based upon the width of the base. Therefore, maximum extension within a working space may be considered most desirable for maximum stability of a stepladder.

When the locking pin 283 is engaged within an engagement locking hole 201, the stepladder 100 may be readily adjusted to another and different extension by grasping the handle 266, placing a thumb upon the lower portion of the lock release lever 282 and pushing the lock release lever 282 against the resistance of the biasing means. The lock release lever 282 may then pivot to pull the locking pin 283 free of the engagement locking hole 201. Once the locking pin 283 is free, movement of handle 266 may move the sliding collar 250 past engagement locking hole 201, and lock release lever 282 may be released. The locking pin 283, although biased, may ride upon the outer surface of the center post 200 until it engages another engagement locking hole 201, at which point it may snap into engagement to lock the sliding collar 250.

The center post 200 may thus function as a vertical guide or tracking device defining the vertex of planes of extension of the rear legs 120 and step assembly 110. Each rear leg 120 may be braced in a triangular brace comprising the rear leg 120 meeting at one pivoting vertex in the top cap 130 extending through the top cap 130 down through the center post 200, through the sliding collar 250 to the inner end of the leg brace 125, then through the leg brace 125 to its outer end that may be pivotally fastened to the rear leg 120. Similarly, the step assembly 110 may be braced in a triangular brace comprising a bisector of the step assembly 110 meeting above the top cap 130 with an imaginary extension of the center post 200, thence down through the center post 200 to the sliding collar 250 to the inner end of the A-brace 260, then through a bisector of the A-brace 260 back to the bisector of the step assembly 110. These support triangles, being formed of members that may be pivoted at each end, may have all of its members essentially in compression or tension load, with bending moments being much reduced. Since the ends of the leg braces 125 may be pivoted, only low bending movements may be imposed. The rear legs 120 may be supported against bending by the leg braces 125.

For each rear leg 120, an imaginary plane of extension may be formed by the vertical plane containing the triangle formed by the rear leg 120, leg brace 125, and the center post 120. The imaginary plane of extension of the step assembly 110 may be considered as a vertical plane extending from the central axis of the center post 200 through a bisector of the plane formed by the two side rails 140. The center post 200 and the sliding collar 250 with its housings 251–253 maintains and coordinates each of these planes of extension so that they may be equally angular, substantially 1200 apart. If the leg braces 125 and A-brace 260 are maintained in coordination by means of the sliding collar 250 and center post 200 and if the planes of extension are maintained at 120° equi-angular spacing, then binding does not occur during retraction or extension of the rear legs 120 and step assembly 110. Working loads may be more equally distributed over the primary support components of the stepladder structure, thereby reducing torsional stresses and enhancing the inherent stability of the structure. Furthermore, by bringing the leg braces 125 and A-brace 260 as single tension resistant members to a single point of pivoted attachment at the sliding collar 250, substantially all unwanted motion may be eliminated from the stepladder 100 and the stepladder 100 may be resistant to twisting motion or other undesired motion even when the stepladder 100 is placed upon an uneven surface.

As has been demonstrated, the present invention provides an improved tripod stepladder having superior ergonomic safety features. While the preferred embodiments of the present invention have been described, additional variations and modifications in those embodiments may occur to those skilled in the art once they learn of the basic inventive concepts. Therefore, it is intended that the appended claims shall be construed to include both the preferred embodiment and all such variations and modifications as fall within the spirit and scope of the invention.

I claim:

1. A stepladder comprising:

a step assembly and two independently articulated legs pivoted from a top cap, the step assembly having two side rails pivotally connected to the top cap along a common axis and one or more steps affixed therebetween;

a center post with an upper end and a lower end, the upper end fixed to the top cap, the center post extending downwardly and vertically from the top cap;

a sliding collar journaled on the center post;

leg braces, each leg brace pivotally affixed at a first end to the sliding collar and pivotally affixed at a second end to a respective one of the legs, the leg braces of a length that the center post is at equal angles vertically to each leg;

an A-brace pivotally affixed at a first end to the sliding collar and pivotally affixed at a second end to the step assembly;

means on the sliding collar for maintaining the planes of extension for the legs and step assembly at equal radial angles with respect to each other;

the stepladder having an operable position defined by the sliding collar in a lowest position on the center post causing the rear legs and step assembly to be fully extended and a closed position defined by the sliding collar in a highest position on the center post causing the rear legs and step assembly to be substantially touching;

wherein the plane of extension for one of the legs is a vertical plane formed by the respective leg brace, the respective leg and the center post and the plane of extension for the step assembly is a vertical plane extending through the center post and a bisector of a plane formed by the side rails, whereby the planes of extension are at 120° angles with respect to each other.

2. The stepladder described in claim 1, further comprising a stop block journaled on the center post, the stop block supported by and resting upon a horizontal flange the lower end of the center post.

3. The stepladder described in claim 2, wherein the A-brace pivots from a tab connected to an uppermost step of the step assembly, so that the A-brace forms a platform.

4. The stepladder described in claim 2, wherein the A-brace pivots from a tab connected to each of the side rails and aligned with a step.

5. The stepladder described in claim 1, wherein the side rails are parallel.

6. The stepladder described in claim 1, wherein the sliding collar may be secured into a position on the center post by a latching assembly therein.

7. The stepladder described in claim 1, wherein the sliding collar may be secured into a position on the center post by a locking assembly therein.

8. The stepladder described in claim 7, further comprising an engagement locking hole in the center post and the latching assembly comprising a locking pin supported by the sliding collar and sized for insertion into the engagement locking hole;

a lock release lever operatively connected with the locking pin for longitudinally moving the locking pin; and a biasing means applying a biasing force to the lock release lever in a direction urging the locking pin into the locking hole;

whereby the locking pin is withdrawn from the engagement locking hole by manual pressure applied on the lock release lever, and the locking pin maintains its engagement with the engagement locking hole in the absence of manual pressure on the lock release lever.

9. The stepladder described in claim 8, wherein the lock release lever is operatively connected with the locking pin by a first set of teeth arcuately arranged along an upper edge of the lock release lever that are engaged with a second set of teeth arranged linearly along a lower edge of the locking pin.

10. The stepladder described in claim 8, wherein a first end of the locking pin engaging the engagement locking hole is circular and a second end of the locking pin is square.

11. The stepladder described in claim 8, wherein the biasing means is a spring.

12. The stepladder described in claim 11, wherein the spring comprises two coils aligned along a common axis through the center of each coil.

13. The stepladder described in claim 8, further comprising a plurality of engagement locking holes linearly arranged along the center post, a highest engagement locking hole at a highest position on the center post for the sliding collar and a lowest engagement locking hole a lowest-position on the center post for the sliding collar.

14. An actuating apparatus for a stepladder having a step assembly, a first leg, and a second leg, the legs being independently articulated, the legs and step assembly pivotally attached to a top cap, each leg pivoting along a vertical plane, the vertical planes separated by an angle of about 120°, the actuating apparatus comprising a center post with an upper end and a lower end, the center post extending downwardly from an underside of the top cap, the center post with a horizontal flange at the lower end;

a sliding collar journaled on the center post, the sliding collar with a first housing, a second housing, and a third housing, each housing having a centerline, each centerline extending radially outward from the center post at an angle of approximately 120° with an adjacent centerline;

a means for locking the sliding collar at a position along the center post;

a first and second rigid leg brace, the first leg brace pivotally affixed at a first end within the first housing and pivotally affixed at a second end to the first leg, the second leg brace pivotally affixed at a first end within the second housing and pivotally affixed at a second end to the second leg, the leg braces of a length that the center post is at equal angles vertically to each leg;

an A-brace pivotally affixed at a first end within the third housing and pivotally affixed at a second end to the step assembly; the A-brace of such a length that it is substantially horizontal when the step assembly is fully extended; and a stop block journaled on the center post, the stop block supported by and resting upon the horizontal flange.

15. The actuating apparatus described in claim 14, further comprising a latching assembly for securing the sliding collar at a position on the center post.

16. The actuating apparatus described in claim 14, wherein the center post has a plurality of engagement locking holes linearly spaced along the center post.

17. The actuating apparatus described in claim 16, further comprising a locking pin supported by the sliding collar and sized for insertion into one of the engagement locking holes;

a lock release lever operatively connected with the locking pin for longitudinally moving the locking pin; and a biasing means applying a biasing force to the lock release lever in a direction urging the locking pin into one of the locking holes;

whereby the locking pin is withdrawn from one of the engagement locking holes by manual pressure applied on the lock release lever, and the locking pin maintains its engagement with the respective engagement locking hole in the absence of manual pressure on the lock release lever.

* * * * *